United States Patent [19]

Schwengeler

[11] Patent Number: 4,576,342

[45] Date of Patent: Mar. 18, 1986

[54] APPARATUS FOR LIFTING A WOUND YARN PACKAGE

[75] Inventor: Peter Schwengeler, Winterthur, Switzerland

[73] Assignee: Rieter Machine Works Limited, Winterthur, Switzerland

[21] Appl. No.: 616,675

[22] Filed: Jun. 4, 1984

[30] Foreign Application Priority Data

Jun. 10, 1983 [CH] Switzerland ..... 3190/83

[51] Int. Cl.[4] ..... B65H 63/00; B65H 63/024; B65H 63/08

[52] U.S. Cl. ..... 242/36; 242/37 R; 242/39

[58] Field of Search ..... 242/36, 37 R, 39, 18 DD, 242/35.5 A, 35.5 R; 57/263, 270

[56] References Cited

U.S. PATENT DOCUMENTS

| | | | |
|---|---|---|---|
| 3,815,347 | 6/1974 | Nemec et al. | 57/263 |
| 3,911,658 | 10/1975 | Smith | 57/263 |
| 4,150,532 | 4/1979 | Ligonês | 57/263 |

FOREIGN PATENT DOCUMENTS

| | | | |
|---|---|---|---|
| 603782 | 10/1934 | Fed. Rep. of Germany | 242/36 |
| 1807023 | 6/1969 | Fed. Rep. of Germany | 242/36 |
| 798232 | 3/1936 | France | 242/36 |
| 2210681 | 7/1974 | France . | |
| 2370807 | 6/1978 | France . | |
| 569765 | 6/1945 | United Kingdom . | |
| 589088 | 6/1947 | United Kingdom . | |
| 1457741 | 12/1976 | United Kingdom . | |
| 2016538 | 9/1979 | United Kingdom . | |

*Primary Examiner*—Stanley N. Gilreath
*Attorney, Agent, or Firm*—Werner W. Kleeman

[57] ABSTRACT

The package lift apparatus serves for lifting a wound yarn package in contact with a rotating drive roll which drives the yarn package in a textile machine. Known equipment of this type requires a considerable degree of manual operation or exhibits a relatively complicated, and thus, expensive construction which is prone to malfunction. These drawbacks are avoided with the inventive yarn package lift apparatus which contains a piston-and-cylinder unit, wherein the piston rod of the piston carries a package support member. During one time interval the piston is exposed to a drive force which moves the package support member against a lower region of the package surface and thus lifts the yarn package from the drive roll. When the package support member is in an extended position the pressure or force exerted by the yarn package upon this package support member causes canting of the piston against the cylinder, so that from the moment of such canting of the piston the package support member is fixedly clamped or jammed in its yarn package supporting position. Due to the action of a continually exerted return or restoring force the piston and the package support member move back into their starting positions whenever there is merely exerted a slight brief lifting of the yarn package.

20 Claims, 3 Drawing Figures

Fig. 2
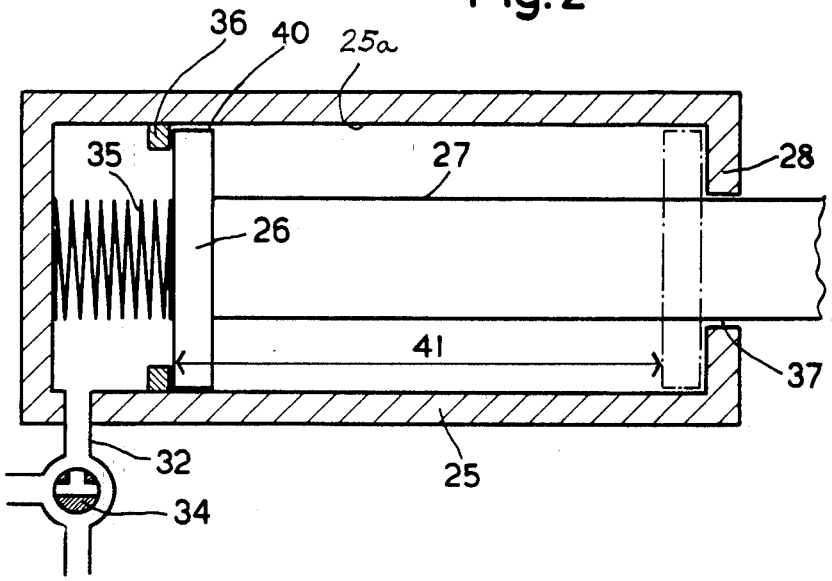
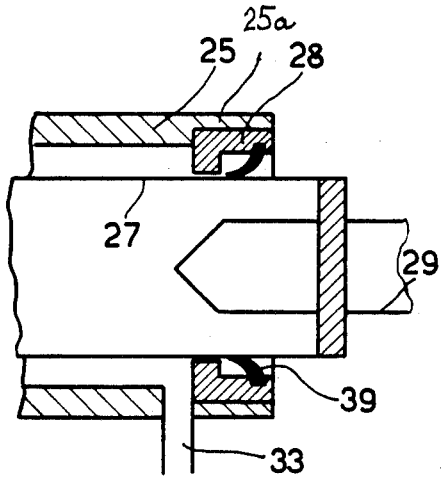
Fig. 3

APPARATUS FOR LIFTING A WOUND YARN PACKAGE

BACKGROUND OF THE INVENTION

The present invention relates to a new and improved construction of an apparatus for lifting a wound yarn package from a drive roll serving to drive such yarn package in a textile machine, there being provided a package support member for lifting and supporting the yarn package, this package support member having a front contact region extending substantially parallel to the lengthwise axis of the wound yarn package and movable into a package lifting position against the lower region of the outer surface of the yarn package during the yarn package lift-off movement which involves a movement of the package support member at essentially right angles or normal to the direction of extent or lengthwise axis of the front contact region i.e., at essentially right angles or normal to the yarn package axis.

During winding of a yarn or thread or the like into a wound package, the latter must be separated from the drive roll driving the yarn package when a yarn breakage occurs or when the yarn package has been fully wound. In other words, the yarn package must be lifted from the drive roll and thereafter braked. In this way, it is possible to avoid damage to the wound yarn or thread and to the package surface through unnecessary work on the package surface with a constant package diameter. Furthermore, the free yarn or thread end is not ground into the wound yarn package or the like.

In German published Pat. No. 2,130,684 there is disclosed an apparatus which is employed in conjunction with an open-end spinning machine, wherein the operation of withdrawing the broken yarn or thread is interrupted in order to enable piecing of a length of yarn upon occurrence of a yarn or thread break. For this purpose, a wedge-shaped device can be inserted between the yarn package and the drive roll. A lever also can be pivoted such that it lifts the yarn package from the drive roll by means of a tongue. Special measures or steps are required for operation both during pivoting of the lever and the wedge-shaped device into their operable positions and also during withdrawal thereof.

German published Pat. No. 2,909,911 teaches lifting of the wound yarn package by means of a hand grip and thereafter laying the yarn package upon a yarn package support. This yarn package support rests upon an abutment surface. A spring serves to withdraw the yarn package support, and this spring must be tensioned during the outward movement of such yarn package support. Equipment designed in accordance with the teachings of this patent therefore requires a considerable degree of manual operation.

In the yarn package lift device disclosed in U.S. Pat. No. 4,149,679, granted Apr. 17, 1979, lifting of the yarn package is effected by means of a rod which is grasped by a pivotably mounted clamp element which, during lifting of the pivot axis of the clamp element, joins against the rod and thus lifts the yarn package. A return spring is provided for removal of the interference or jamming action. The position on the rod at which grasping occurs is variable or undefined, in particular because of dirt or contaminants which cannot be avoided, and therefore lifting takes place through distances of uncontrollably variable length. Furthermore, the rod is continuously in motion. Since the yarn package is never exactly round, this rod is especially subjected to a continuous vibration. Such, in turn, causes fretting corrosion and produces wear of the rod.

SUMMARY OF THE INVENTION

Therefore, with the foregoing in mind it is a primary object of the present invention to provide a new and improved yarn package lift apparatus which is not associated with the aforementioned shortcomings and drawbacks of the aforediscussed prior art constructions.

Another and more specific object of the present invention is directed to a new and improved construction of a yarn package lift apparatus which affords a safe, reliable and protective lift-off of a wound yarn package from a drive roll serving to drive such yarn package.

Another important object of the present invention relates to a new and improved construction of a yarn package lift apparatus which is relatively simple in design, quite economical to manufacture, extremely reliable in operation, not readily subject to breakdown or malfunction, and requires a minimum of maintenance and servicing.

Now in order to implement these and still further objects of the invention, which will become more readily apparent as the description proceeds. the yarn package lift apparatus of the present development is manifested by the features that there is provided means for moving the package support member into a package lifting and supporting position, such moving means comprising a piston-and-cylinder unit, wherein the piston rod of the piston is rigidly or fixedly connected at its end remote from the piston with the package support member. Means serve to apply a drive force which is effective during a predetermined time interval to the piston in order to accomplish the yarn package lift movement. Furthermore, for returning the package support member there is provided a continually operative return or restoring force which is smaller than the drive force, and in the package lifting position of the package support member the pressure of the yarn package on the package support member causes canting of the piston relative to the cylinder.

A notable advantage of the yarn package lift apparatus of the present invention resides in its considerable operational simplicity. After starting lifting of the yarn package from the drive roll there are not required any further operations. Because of the canting of the piston within the cylinder, the package support member remains positioned in its canted or jammed condition as long as it is loaded by the weight of the yarn package, that is to say, during any desired time interval. Upon return of the yarn package into its operational condition, or upon replacement of the yarn package by an empty bobbin tube, due to the lifting of the yarn package which thus occurs and by virtue of the continuously operative or effective return or restoring force, the package support member is automatically moved back into its starting or initial portion. This operation can be accomplished without the need for any control elements.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 2 is a fragmentary sectional view of a modified construction of such yarn package lift apparatus; and FIG. 3 is a fragmentary sectional view showing a detail of a still further exemplary embodiment of the yarn package lift apparatus of the invention.

DETAILED DESCRIPTION OF THE PREFERRED EMBODIMENTS

Figure 1:
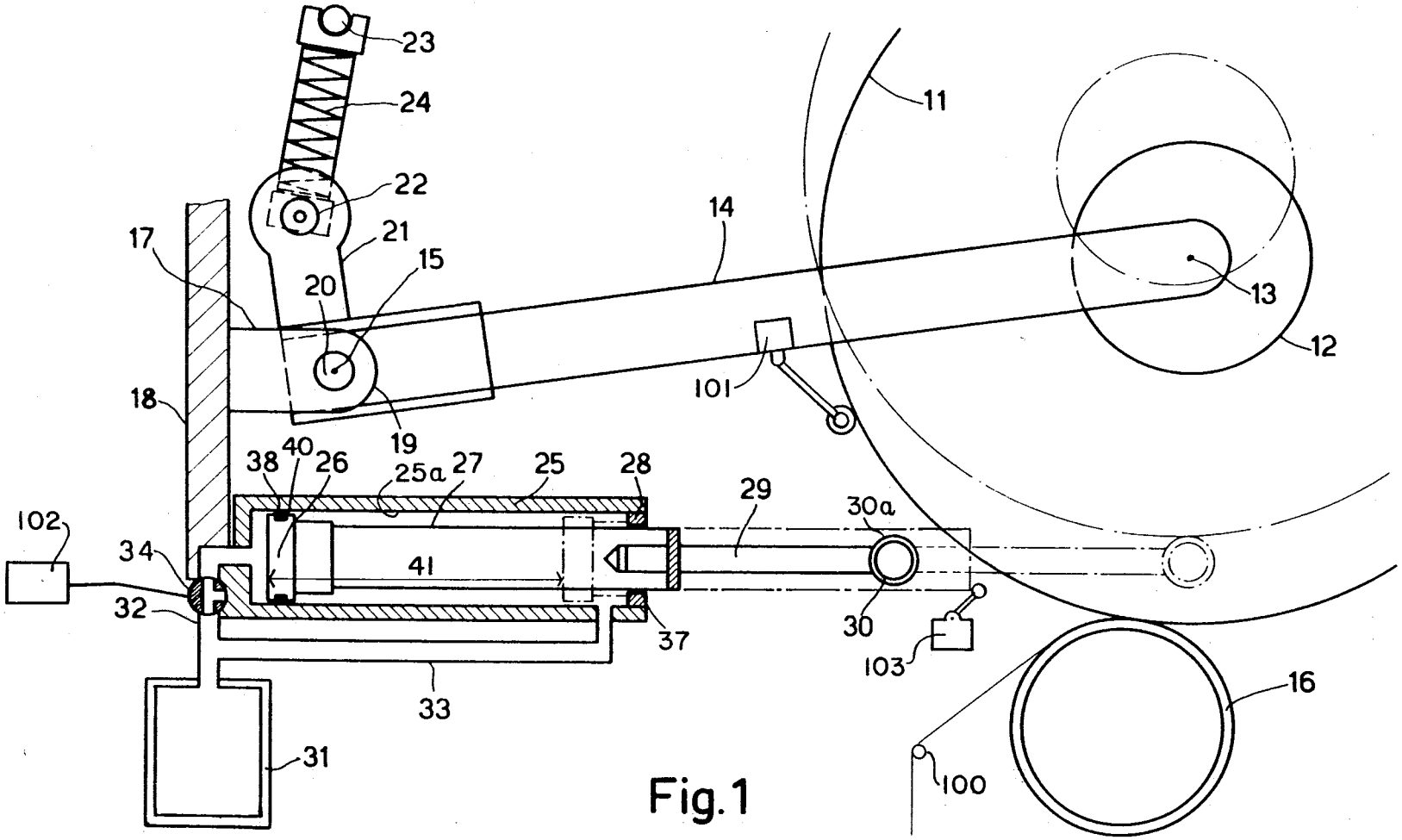
FIG. 1 is a front view, partially in section, of a yarn package lift apparatus constructed according to the present invention.

Describing now the drawings, it is to be understood that only enough of the yarn package lift apparatus and the related textile machine with which the same is employed has been shown in the drawings as needed for those skilled in the art to readily understand the underlying principles and concepts of the present invention while simplifying the illustration of such drawings. Turning attention now to FIG. 1, there is depicted therein a yarn or thread package 11 where the yarn or thread or the like is wound onto a bobbin tube 12. As a matter of convenience the terms "yarn" or "thread" or "filamentary materials" which can be wound onto the bobbin tube 12 will be hereinafter simply referred to usually as a "yarn." The yarn package 11 is rotatable about an axis 13 which also defines the lengthwise axis of the wound yarn package 11. This yarn package 11 is supported by two carrier arms or arm members 14, only one of which is particularly visible in the showing of FIG. 1, the other such carrier arm 14 being located behind and in spaced relationship from the depicted carrier arm 14 of FIG. 1. These carrier arms or arm members 14 are pivotable about an axis 15. A drive roll or roller 16 serves to rotate the yarn package 11.

A support element 17 is fixedly secured to a machine wall or frame portion 18. This support element 17 carries the carrier arms 14 in a bracket or projecting element 19 by means of a shaft 20. Each carrier arm 14 is fixedly secured with a further arm or arm member 21 arranged essentially at right angles thereto. Each of these further arms 21 is provided with a bearing 22. Between each of these bearings 22 and a further bearing or bearing means 23 provided for each arm 21 there is arranged a respective compression spring 24 or equivalent structure which is pivotably secured to the bearings 22 and 23.

A piston-and-cylinder unit 25, 26, composed of a cylinder 25 and a piston 26 reciprocatable therein, is secured to the machine wall 18 or the like. The piston 26 is provided with a piston rod 27 which has a somewhat smaller cross-sectional area than that of the piston or piston member 26. This piston 26 is movable to-and-fro between its position indicated in full or solid lines and its position indicated in chain-dot or phantom lines. The piston 26 engages an internal or inner wall 25*a* of the cylinder 25 with a small amount or desired magnitude of play or clearance 40. The piston rod 27 is guided in a guide means 28 provided at one end of the cylinder 25, as clearly shown in FIG. 1. The piston rod 27 engages the guide means 28 with a small amount or desired magnitude of play or clearance 37. A package support member 29 is fixedly mounted in the piston rod 27 and is firmly supported thereby. This package support member 29 has a front contact region 30, the lengthwise axis of which extends substantially parallel to the yarn package axis 13.

A suitable pressurized fluid medium, such as a hydraulic or pneumatic fluid medium or fluid is provided in a supply reservoir or chamber 31. A conduit or line 32 extends from the supply reservoir or chamber 31 and opens into the cylinder 25 at that end of the displacement path of the piston 26 which is located remote from the package support member 29, in other words this conduit or line 32 opens at the left-hand end of the cylinder 25 depicted in FIG. 1. A further conduit or line 33 flow communicates with and opens into the opposite end of the cylinder 25, i.e. here the right-hand end of the cylinder as shown in FIG. 1. A suitable closure or shut-off member 34, for instance a valve, is mounted in the conduit or line 32.

During operation of the textile machine the yarn package 11 is rotated by the drive roll 16 and a not particularly illustrated yarn is thus wound up onto the bobbin tube 12 to form this yarn package 11. The yarn package lift apparatus is preferably used for open-end spinning, but it is to be understood that it is also usable for other applications, for instance in conjunction with winding machines. If, for instance, there occurs a yarn breakage, or if a yarn package is fully wound, or if the winding operation must be interrupted for any other reason, then the closure member 34 is appropriately activated or operated and assumes the position shown in FIG. 1. Consequently, the pressurized fluid medium is delivered from the supply reservoir or chamber 31 and such fluid medium exerts a pressure via the conduit or line 32 upon that side or face of the piston 26 which is located remote from the package support member 29. The force due to this pressure is greater than that due to the pressure which is produced by the fluid acting upon the opposite face of the piston 26 via the other conduit or line 33 because, as will be observed with regard to the showing of FIG. 1, the left-hand side or face of the piston 26 which is subjected to the action of the fluid medium delivered through the line 32 is larger in its effective cross-sectional area than the right-hand side or face of the piston 26 subjected to the action of the fluid medium delivered through the other line or conduit 33. Consequently, a drive force is produced which operates upon the piston 26 and results in a movement of this piston 26 (and thus also the piston rod 27 and the package support member 29) which is towards the right of the showing of FIG. 1. This movement of the piston 26 defines a stroke length 41 between its leftmost and rightmost position in FIG. 1. The position assumed by the package support member 29 following such movement, has been indicated by chain-dot or phantom lines. It should be apparent that during this movement of the package support member 29 its front contact region 30 thereof engages the lower portion of the package surface. Thus the yarn package 11 is lifted into the position indicated in chain-dot or phantom lines, and thus is lifted off the drive roll or roller 16.

The compression spring 24 associated with each carrier arm 14, and which carrier arms 14 are located at opposite sides of the yarn package 11, serves to compensate the weight of such yarn package 11. At the start of the winding operation the quantity of yarn wound onto the bobbin tube 12 is small, the weight of the yarn package 11 is small, and the bobbin tube 12 is located close to the drive roll 16. Thus, the carrier arm 14 shown in FIG. 1 extends downwardly at an angle from the axis 15 towards the axis 13, and thus the arm 21 extends upwardly at an angle towards the right of the showing of FIGS. 1. Thus, when the yarn package dimensions are relatively small, the arm 21, the bearing 22 and the compression spring 24 all lie to the right of a hypothetical plane passing through the axis 15 and the axis of the bearing 23, as viewed in FIG. 1. Therefore those elements exert a toggling action and the yarn package 11 is pressed against the drive roll 16 by the action of the depicted compression spring 24. When the yarn package diameter is large the illustrated conditions are realized, and consequently the bearing 22 is located to the left of the plane defined by the axis 15 and the axis of the bearing 23. In this position the compression spring 24 presses the yarn package 11 upwardly. Obviously, the same workings prevail at the other non-illustrated carrier arm 14. The described arrangement therefore now operates in a compensating fashion on the contact pressure which the yarn package 11 exerts against the drive roll 16.

When the piston 26 is located in the position indicated in chain-dot or phantom lines at the right-hand end of the cylinder 25 located at the side of the package support member 29, and furthermore, when the yarn package 11 rests upon this package support member 29, then there is produced a canting or tilting of the piston 26 relative to the cylinder 25. Consequently, the edges of the piston 26 thereby jam or bind against the internal or inner wall 25*a* of the cylinder 25. It is possible that with the canting of the piston 26 against the internal or inner wall 25*a* of the cylinder 25 there is superimposed thereupon a canting of the piston rod 27 in the guide means or guide 28. Thus, the package support member 29 is retained in its package lifting position as long as the yarn package 11 exerts a pressure or force upon this package support member 29. When the yarn package 11 has been lifted by the extended package support member 29, then the line 32 is again closed by appropriately operating the closure member 34 as will be explained more fully hereinafter. In any event, it will be recognized that the pressure exerted on the package support member 29 is composed of the weight of the yarn package 11, the weight of the carrier arms 14 and the pressure exerted by the springs 24 (positive or negative).

The aforementioned closing of the conduit or line 32 by the closure member 34 is produced by rotating this closure member 34 through 90° in a counterclockwise direction. Thus, the excess pressure on the side of the piston 26 facing away from the package support member 29 is reduced by permitting the fluid medium to escape into the environment or into a reservoir at ambient pressure. The pressure caused by the fluid medium in the conduit or line 33 acting on the side or face of the piston 26 confronting the package support member 29 is too weak to overcome the jamming action caused by the canting of the piston 26, so that the package support member 29 remains in the position indicated in chain-dot or phantom lines as long as pressure is exerted on the package support member 29 by the yarn package 11.

After the cause of the cessation of the winding operation has been removed, for example the yarn breakage has been eliminated, the yarn package 11 is slightly lifted. Thus, the pressure exerted on the package support member 29 disappears together with the canting of the piston 26. The return force which is present as a result of the excess pressure transmitted by means of the conduit or line 33 now becomes effective, and this in turn causes return of the piston 26, the piston rod 27 and the package support member 29 back into their starting positions indicated in full lines. In order to avoid damage to the yarn located at the cylindrical outer surface of the yarn package 11, the package contact region 30 of the package support member 29 is particularly constructed in such a manner that the yarn is protected to the greatest extent possible. According to one exemplary embodiment of the invention the package contact region can be constituted by a rotatably supported roller or roll, generally indicated by reference character 30*a* in FIG. 1.

From the illustration of FIG. 1 it will be readily evident that the cylindrical surface of the lifted yarn package 11 always has the same spacing from the drive roll 16 independent of the diameter of the yarn package 11. This affords the advantage that the piston-and-cylinder unit 25, 26 can be fixedly mounted since it is unnecessary to take into account any varying package diameter.

Turning attention now to FIG. 2, there is depicted therein a modified embodiment of the piston-and-cylinder unit or device 25, 26. Here, the parts which are the same or analogous to those depicted in the previously described embodiment of FIG. 1 have been conveniently indicated by the same reference characters. Thus, there will be again recognized the cylinder 25, the piston 26 reciprocatable within its cylinder chamber, the piston rod 27 which is affixed to the piston 26, the guide means 28, and the conduit or line 32 for the pressurized fluid medium as well as the closure member 34 for blocking or controlling the flow of such fluid medium. As a matter of convenience in carrying out the illustration of the drawing of FIG. 2, there has been omitted the showing of the package support member, which is for instance like the package support member 29 of FIG. 1, and which is secured to the piston rod 27. In the modified construction of FIG. 2, the closure member 34 is shown located in a position in which access of the fluid medium to the interior or inner chamber of the cylinder 25 is blocked, and such inner chamber of the cylinder 25, as recognized from the illustration of FIG. 2, is open at its left end to the environment or surroundings. It will also be observed that no conduit or line is here provided for producing a returning or restoring force for the piston 26 by means of pressurized fluid medium. Instead, with this modified embodiment there is provided a tension spring 35 or equivalent means for establishing such returning or restoring force. In addition, there is also shown an abutment or stop 36 for limiting the stroke of the piston 26 towards the left-hand end of the cylinder 25.

With the embodiment depicted in FIG. 2, return of the piston 26 from the package lifting position indicated in phantom lines at the right-hand end of the cylinder 25, into the starting position indicated in full or solid lines at the left-hand end of such cylinder 25, occurs due to the return or restoring force produced by the tension spring 35. By virtue of the action of this tension spring 35 the piston 26 is moved back into its starting or initial position until it comes to rest against the abutment or stop 36.

In the embodiment of FIG. 2, play or clearance 37 of any desired magnitude can be provided between the piston rod 27 and the guide means 28. In this way there can be provided any desired freedom of movement for the purpose of canting of the piston 26 relative to the cylinder 25.

Equipment operating in accordance with the exemplary embodiments of FIGS. 1 and 2 is suitable, in particular, for an automatic operation. In such an arrangement, opening of the closure or shut-off member 34 is controlled by a conventional yarn or thread monitoring system 100 which, for example, is effective upon occurrence of a yarn break. Such opening of this closure member 34 is also controlled by a conventional monitoring system 101 which operates as soon as the yarn package 11 has reached a predetermined size.

Closing of the closure member 34 can be effected automatically by a conventional timer control device 102 after a predetermined time interval which is of such duration that the lifting of the yarn package 11 will have occurred under all circumstances. It can, however, also be controlled in that, for instance, a conventional transducer or limit switch 103 operatively engaging the package support member 29 causes generation of a suitable signal when it reaches its extended position where it has been thrusted out of the cylinder 25.

In this way, closure of the closing member 34 and the return of the package support member 29 can be made independent of the time of arrival of service equipment provided for a large number of spinning positions or locations and patrolling longitudinally of the textile machine. Thus, the service equipment does not have to be provided with a special control means for the closure member 34.

The jamming or binding of the piston 26 against the internal or inner wall 25*a* of the cylinder 25 requires the presence of a certain amount of play or clearance 40 between these parts. The provision of a sealing ring 38, shown in FIG. 1 for instance, on the piston 26 safeguards against loss of fluid medium due to this play 40. In the exemplary embodiment of FIG. 1, the escape of the fluid medium or fluid through the play or clearance 37 between the guide means 28 and the piston rod 27 also must be avoided. A possible arrangement serving to accomplish this purpose has been depicted in FIG. 3. Such FIG. 3 depicts in fragmentary view the end of the cylinder 25 of FIG. 1 which is located adjacent the package support member 29. In accordance with the embodiment of FIG. 3, the substantially ring-shaped or annular guide means 28 is mounted on the internal wall 25*a* of the cylinder 25. An annular or ring-shaped rubber lip or lip seal 39 is mounted in the guide means 28. The pressurized fluid medium fed by the conduit or line 33 presses the rubber lip 39 against the piston rod 27, so that an effective seal for the fluid medium is obtained.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for lifting a wound yarn package having an outer surface and a lengthwise axis from a drive roll serving for the drive thereof on a textile machine, comprising:

a package support member for lifting and supporting the yarn package;

said package support member being provided with a forward package contact region for contacting the yarn package and extending substantially parallel to the lengthwise axis of the yarn package;

means cooperating with said package support member for moving said package contact region into a package lifting position against a lower portion of the outer surface of the yarn package during a yarn package lift-off movement involving a movement of the package support member substantially normal to the package contact region;

said means for moving the package support member comprising a piston-and-cylinder unit composed of a cylinder and a piston reciprocatable within said cylinder;

said piston being provided with a piston rod fixedly connected at an end thereof remote from the piston with said package support member;

means for subjecting said piston to a drive force effective during a predetermined time interval in order to accomplish the yarn package lift-off movement;

means for returning the package support member into an initial position where it does not support the yarn package by applying a continually operative return force which is small relative to the drive force produced by said subjecting means;

said piston, said piston rod and said cylinder of said piston-and-cylinder unit coacting with one another such that a pressure of the wound yarn package upon said forward package contact region produces a tendency to rotate said piston and said piston rod within said cylinder in a plane extending substantially perpendicular to the lengthwise axis of the wound yarn package;

said cylinder coacting with said piston and said piston rod to produce forces countering said tendency to rotate; and said forces overriding said continually operative return force and thereby restraining said package support member in said package lifting position.

2. The apparatus as defined in claim 1, further including:

guide means for the piston rod for closing said cylinder at an end thereof confronting the package support member.

3. The apparatus as defined in claim 1, wherein:

said means for subjecting the piston to the drive force comprises a line through which flows a pressurized fluid medium to said piston-and-cylinder unit;

said line opening into said cylinder;

a closure member cooperating with said line; and said line opening into said cylinder at an end thereof located remote from said package support member.

4. The apparatus as defined in claim 1, wherein:

said package contact region of said package support member comprises a rotatably supported roll extending over the length of the yarn package.

5. The apparatus as defined in claim 1, wherein:

said means for the returning the package support member comprises a spring.

6. The apparatus as defined in claim 3, further including:

guide means for the piston rod for closing said cylinder at an end thereof confronting adjacent the package member;

a further continuously open line for fluid medium flow communicating with an inner chamber of the cylinder at an end thereof located adjacent the package support member;

said piston rod including a piston rod portion which is smaller in its cross-sectional area than the cross-sectional area of the piston; and said guide means comprising a resilient element sealing the inner chamber of the cylinder.

7. The apparatus as defined in claim 5, further including:

guide means for guiding said piston rod at an end of the cylinder adjacent the package support member; and said piston rod cooperating with said guide means such that clearance is provided between said piston rod and said guide means.

8. An apparatus for lifting a wound yarn package having an outer surface from a drive roll serving for the drive thereof on a textile machine, comprising:

a package support member for lifting and supporting the yarn package;

said package support member being provided with a package contact region for contacting the yarn package at an outer surface thereof;

means cooperating with said package support member for moving said package contact region into a package lifting position against a portion of the outer surface of the yarn package during a yarn package lift-off movement;

said means for moving the package support member comprising a piston-and-cylinder unit composed of a cylinder and a piston reciprocatable within said cylinder;

said piston being provided with a piston rod connected at an end thereof remote from the piston with said package support member;

means for subjecting said piston to a drive force in order to accomplish the yarn package lift-off movement;

means for returning the package support member into an initial position by applying a return force which is small relative to the drive force produced by said subjecting means;

said piston, said piston rod and said cylinder of said piston-and-cylinder unit coacting with one another such that a pressure of the wound yarn package upon said forward package contact region produces a tendency to rotate said piston and said piston rod within said cylinder in a plane extending substantially perpendicular to the lengthwise axis of the wound yarn package;

said cylinder coacting with said piston and said piston rod to produce forces countering said tendency to rotate; and said forces overriding said continually operative return force and thereby restraining said package support member in said package lifting position.

9. The apparatus as defined in claim 3, further including:

a wound yarn package monitoring system; and said wound yarn package monitoring system comprising means for sensing a diameter of the outer surface of the wound yarn package and means for determining when said sensed diameter exceeds a predetermined desired diameter and generating a signal in response thereto for opening said closure member.

10. The apparatus as defined in claim 3, further including:

a thread monitoring system; and said thread monitoring system comprising means for sensing a possible breakage of the yarn being wound onto the wound yarn package and means for generating a signal in response thereto for opening said closure member.

11. The apparatus as defined in claim 3, further including:

transducer means cooperating with said package support member for detecting an attainment of said package lifting position by said package support member and for generating a signal in response thereto for closing said closure member.

12. The apparatus as defined in claim 3, further including:

timer control means for generating a signal when said closure member has been opened for a predetermined time interval greater than the duration of the yarn package lift-off operation for closing said closure member.

13. An apparatus for lifting a wound yarn package having an outer surface and a lengthwise axis from an initial position in which the wound yarn package is in operative engagement with a drive roller of a textile machine into package lifting position in which the wound yarn package is disengaged and remote from the drive roller, such apparatus comprising:

a package support member for lifting the wound yarn package into the package lifting position and supporting the wound yarn package in the package lifting position for a desired length of time;

the outer surface of the wound yarn package having a lower region;

said package support member having a forward end;

said package support member comprising a package contact region arranged at said forward end and extending substantially parallel to the lengthwise axis of the wound yarn package for contacting said lower region of the wound yarn package;

a piston rod having a first predetermined outside diameter, said piston rod being rigidly united with said package support member and extending in a direction substantially parallel to said package support member;

a piston having a second predetermined outside diameter, said piston being rigidly united with said piston rod arranged substantially coaxial with said piston rod;

a cylinder having a first predetermined inside diameter greater than said second predetermined outside diameter by a first predetermined small amount for accommodating said piston with play;

said cylinder being rigidly secured to the textile machine and defining a displacement path for said piston, said piston rod and said package support member;

said displacement path extending in a direction transverse to the lengthwise axis of the wound yarn package and between the drive roller and the lengthwise axis of the wound yarn package;

said cylinder comprising guide means having a second predetermined inside diameter greater than said first predetermined outside diameter by a second predetermined small amount for accommodating said piston rod with play;

said cylinder having a first end remote from the wound yarn package and the drive roller;

said cylinder having a second end located between said first end and the wound yarn package and the drive roller and remote from said first end by a predetermined stroke length;

said guide means being arranged at said second end;

said piston having a first position within said cylinder near said first end and in which said piston rod and said package support member are retracted in relation to the wound yarn package and the drive roller;

said piston having a second position within said cylinder near said second end and in which said piston rod and said package support member are advanced in relation to the wound yarn package and the drive roller such that said package support member engages said lower region of the wound yarn package and lifts the wound yarn package from the initial position to the package lifting position and supports the wound yarn package in the package lifting position;

means for reciprocating said piston between said first position and said second position; and said first predetermined small amount of play, said second predetermined small amount of play and said predetermined stroke length being interrelated such that said piston and said piston rod are freely moveable in said cylinder when said piston is in said first position and when said piston is at a location intermediate said first position and said second position and such that said piston and said piston rod assume a canted orientation substantially immobilizing said piston and said piston rod when said piston is at least substantially in said second position and said package support member is supporting the wound yarn package in the package lifting position.

14. The apparatus as defined in claim 13, wherein:

said piston rod and said package support member are identical.

15. The apparatus as defined in claim 13, wherein:

said second predetermined outside diameter is greater than said first predetermined outside diameter.

16. The apparatus as defined in claim 13, wherein:

said piston engages said cylinder with said first predetermined small amount of play by means of a resilient piston packing.

17. The apparatus as defined in claim 13, wherein:

said guide means of said cylinder comprises resilient sealing means for sealingly engaging said piston rod with said second predetermined small amount of play.

18. The apparatus as defined in claim 13, wherein:

said means for reciprocating said piston comprises means for advancing said piston toward second position and means for retracting said position toward said first position; and said means for advancing said piston comprising a supply of pressurized fluid medium, a conduit connecting said supply to said first end of said cylinder and a closure member for selectively commuting said first end of said cylinder with said conduit or with a fluid medium at ambient pressure.

19. The apparatus as defined in claim 18, wherein:

said means for retracting said piston comprises a further conduit connecting said supply to said second end of said cylinder independently of said closure member.

20. The apparatus as defined in claim 18, wherein:

means for retracting said piston comprises spring means.

* * * * *

UNITED STATES PATENT AND TRADEMARK OFFICE

CERTIFICATE OF CORRECTION

PATENT NO. : 4,576,342

DATED : March 18, 1986

INVENTOR(S) : PETER SCHWENGELER

It is certified that error appears in the above—identified patent and that said Letters Patent is hereby corrected as shown below:

Column 1, line 60, at the end of the line, please delete "joins" and replace it with --jams--

Column 2, line 25, after "proceeds" please delete "," and replace it with --.--

Column 4, line 50, after "most" please delete "position" and replace it with --positions--

Column 5, line 6, after "Therefore" please delete "those" and replace it with --these--

Column 8, line 57, before "member" insert -- support --.

Signed and Sealed this

*Twenty-second* Day of *July 1986*

[SEAL]

*Attest:*

DONALD J. QUIGG

*Attesting Officer*

*Commissioner of Patents and Trademarks*